US005467580A

United States Patent [19]

Francioni

[11] Patent Number: 5,467,580

[45] Date of Patent: Nov. 21, 1995

[54] AUTOMATIC PACKAGING MACHINE

[75] Inventor: Renzo Francioni, Prato Sesia, Italy

[73] Assignee: Cavanna S.p.A., Italy

[21] Appl. No.: 224,880

[22] Filed: Apr. 8, 1994

[30] Foreign Application Priority Data

Apr. 20, 1993 [IT] Italy ..... T093A0267

[51] Int. Cl.[6] ..... B65B 9/06; B65B 65/00

[52] U.S. Cl. ..... 53/550; 53/389.4

[58] Field of Search ..... 53/450, 548, 550, 53/553, 389.2, 389.4

[56] References Cited

U.S. PATENT DOCUMENTS 2,885,848 5/1959 Brien et al. .
4,608,797 9/1986 Shabram, Jr. et al. ..... 53/550 X
4,722,168 2/1988 Heaney ..... 53/550 X
4,840,009 6/1989 Rentmeester et al. ..... 53/550 X
4,947,605 8/1990 Ramsey .
5,044,145 9/1991 Brembilla ..... 53/553 X
5,138,815 8/1992 Groschen, Jr. ..... 53/550 X
5,255,495 10/1993 Kovacs .

*Primary Examiner*—Horace M. Culver
*Attorney, Agent, or Firm*—Evenson, McKeown, Edwards & Lenahan

[57] ABSTRACT

The supporting structure of an automatic packaging machine preferably a continuous-flow horizontal packaging machine, comprises a generally flat, load-bearing frame which extends transverse the direction of advance of the articles being packaged, at least two operative units of the machine being mounted on said frame in a generally bracket-like configuration on opposite sides of the frame itself.

19 Claims, 4 Drawing Sheets

AUTOMATIC PACKAGING MACHINE

DESCRIPTION

Figure 1:
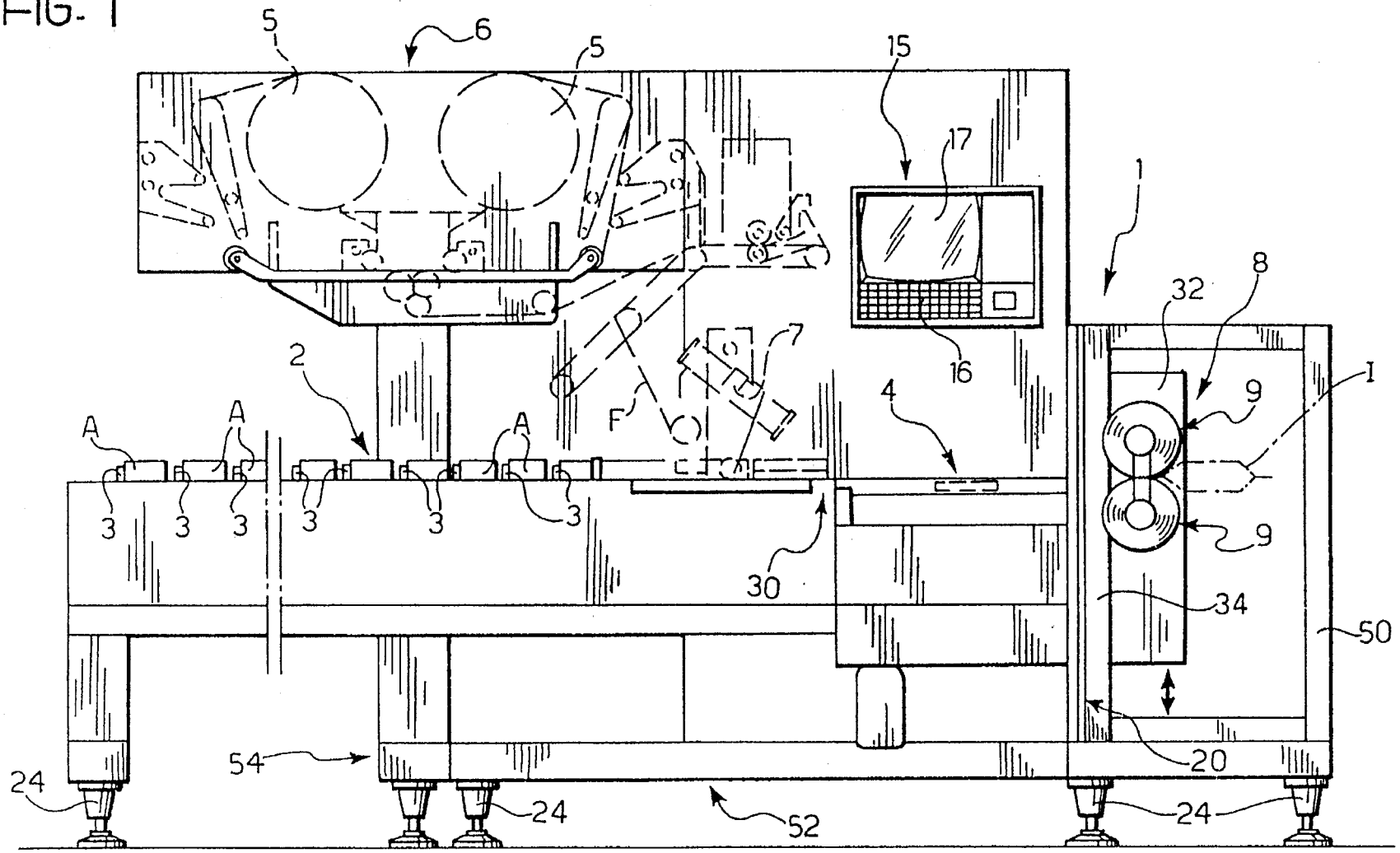

The present invention relates to automatic packaging machines including at least two operative units which can act in succession on articles being packaged which advance in a direction in which the at least two units are aligned.

Packaging machines of the type specified above are well known in the art as is shown, for example, by U.S. Pat. Nos. 4,761,937, 4,862,673, 4,914,889, 4,955,184 and 5,067,307, all assigned to the assignee of the present application.

More specifically, the documents listed above relate to horizontal packaging (wrapping) machines which operate continuously, or substantially continuously, of the type generally called "flow-pack" or "form-fill-seal" machines (in brief FFS).

Usually, packaging machines of this type include, in cascade with each other and possibly with the interposition of auxiliary operative units:

an input conveyor on which an ordered, regular flow of articles to be packaged is advanced, a longitudinal closure unit in which a sheet of wrapping paper which unwinds from a roll located in the upper part of the machine is closed on itself by the bringing together of the two outer edge portions of the sheet; these outer edge portions are then sealed together to form a continuous tubular wrapper into which the articles being packaged are inserted in order, and a transverse closure unit comprising, for example, one or more groups of counter-rotating jaws which squeeze the portions of the continuous tubular wrapper left free between successive articles or groups of articles, and which seal these regions of the wrapper brought into contact with each other as a result of the squeezing and then effect the longitudinal cutting of the continuous tubular wrapper in these regions so as to form the individual packages.

This example is, of course, one of the many possible configurations of a machine of the type specified above. As already stated, the operative units described above may have associated units or auxiliary operative elements which carry out different functions (for example: packing together, accumulating, aligning and orienting of the articles treated, prior discarding of articles with irregular positions or dimensions, discarding of wrappers which contain a different number of articles from that intended, discarding of wrappers which remain accidentally connected together even after the separating action, etc).

In each case, as will become clear from the description below, the specific configuration and structure of the machine is not in itself relevant for an understanding of the invention and for putting it into practice.

In more conventional solutions (in this respect see, for example, U.S. Pat. No. 4,914,889 already mentioned above) the various operative units intended to act in succession on the articles being packaged are driven by a single motor which drives the various units through mechanical transmissions and drive members. This solution has been (and up till now is) adopted particularly because it enables the various operative units to be synchronised exactly (both in terms of their speed and of the relative phasing of their actions) in a simple manner.

Recourse to this solution makes it essential to provide a sort of dorsal spine within the structure of the packaging machine, this, in most cases, being constituted by a strong bench which extends longitudinally on one side of the line of advance of the products being packaged and houses the members (transmissions, reduction gears, etc) for transferring the drive from the main motor to the various operative units of the machine.

This bench structure, in conventional machines, tends to be of considerable size. This is particularly true in more sophisticated machines in that the transmission members and/or the motor drives tend to be very complicated both because of the need to transfer the drive in different directions (for example: the input conveyor and the transverse closure unit of the machine are usually driven by horizontal shafts while the longitudinal closure unit is usually driven by a vertical shaft) and because of the need to provide very different reduction ratios and laws of movement (for example the transverse closure unit, although being driven continuously, must be made to operate with a cyclic "oscillation" of its speed).

In view of its dimensions and corresponding mass (the structure considered above must be able to withstand without difficulty the very strong reactive forces which develop due to the transmission of movement to the various operative units), the said longitudinal structure is also used as the supporting framework for the machine as a whole.

This solution is not, however, satisfactory for various reasons.

In the first place, the longitudinal supporting structure usually extends to the floor and occupies a considerable amount of space making access difficult both for cleaning the floor itself and for cleaning various parts of the machine.

In the second place, exactly because of the location of the supporting structure to one side of the machine, the various operative units of the machine itself are supported in a cantilevered manner on one side of the path of advance of the articles, and hence in a generally unbalanced configuration, with the resulting need further to increase the dimensions and mass of the structure in order to ensure that the various parts of the machine are supported firmly and precisely (this machine is also very prone to give rise to and to propagate vibrations).

A considerable disadvantage of the machines described above is also due to the fact that, in these machines, the operation of changing the format of the machine, that is, the adaptation of its operating characteristics to variations in the dimensions of the articles handled and/or of the packages it is wished to form, is critical.

In practice, in order to change the format of a completely mechanical wrapping machine, it is necessary to adjust the various parts and the transmission members and, as well as being rather complicated to effect, this in most cases requires a degree of physical force. This almost always excludes the possibility of these operations being carried out by the personnel who normally supervise the operation of the machine.

In more recent years various manufacturers have developed so-called "electronic" packaging machines. In these machines the various operative units have respective associated motor drives (typically electric motors) which are synchronised electronically (both as regards speed and the phasing of their actions) instead of being driven by a common motor through drives and transmissions.

One of the main advantages usually recognised in such electronic machines lies in the theoretical simplification of the operation of changing their format.

At least in principle, in an electronic machine, changes in the synchronisation of the various operative units required by a change in format may be effected simply by varying the programming parameters of the electronic control unit which controls the operation of the machine.

In practice, experience has shown however that these advantages are not fully achieved. The operation of changing the format cannot in fact be reduced simply to a variation in the synchronising of the various operative units. On the contrary, in the great majority of cases, it also requires additional adaptations (such as, for example, a variation in the operating height of the transverse closure unit) which require a good degree of skill and ability to effect.

Yet again, in electronic packaging machines in current production, it is often found that the longitudinal support structure typical of conventional mechanical packaging machines remains almost unchanged, with the disadvantages already described above. More than this, the retention of this structure (dictated particularly by the need to provide firm support for the machine as a whole), accompanied by the simplification in the mechanical structure usually housed in the longitudinal structure (in electronic machines the transmissions and drives as well as, for example, eccentric groups which achieve the oscillation in the operating speed of some parts of the machine itself are in fact almost completely eliminated), has led almost all manufacturers to use this longitudinal structure for housing the electronic and electrical control members of the machine.

This solution has however shown itself to be far from optimum: on the one hand, it does not solve the problems of bulk mentioned above; yet again, it means that the electronic and electrical members are located immediately adjacent the purely mechanical members of the machine itself. These latter members often operate in specific conditions of lubrication, temperature etc which can be hostile to the electronic and electrical members, or at least are not the optimum conditions for them.

There is thus a need to provide a packaging machine, particularly of the electronic type, which is able fully to utilise all the advantages resulting from the overcoming of the problems of conventional mechanical machines. This is true particularly with regard to the bulk, the support of the various parts of the machine and, at least indirectly, with regard to making the operation of changing the format as automated as possible.

The object of the present invention is to provide a packaging machine which answers the said requirements in an optimum manner.

According to the present invention, this object is achieved by an automatic packaging machine having the characteristics claimed specifically in the Claims which follow.

Figure 2:
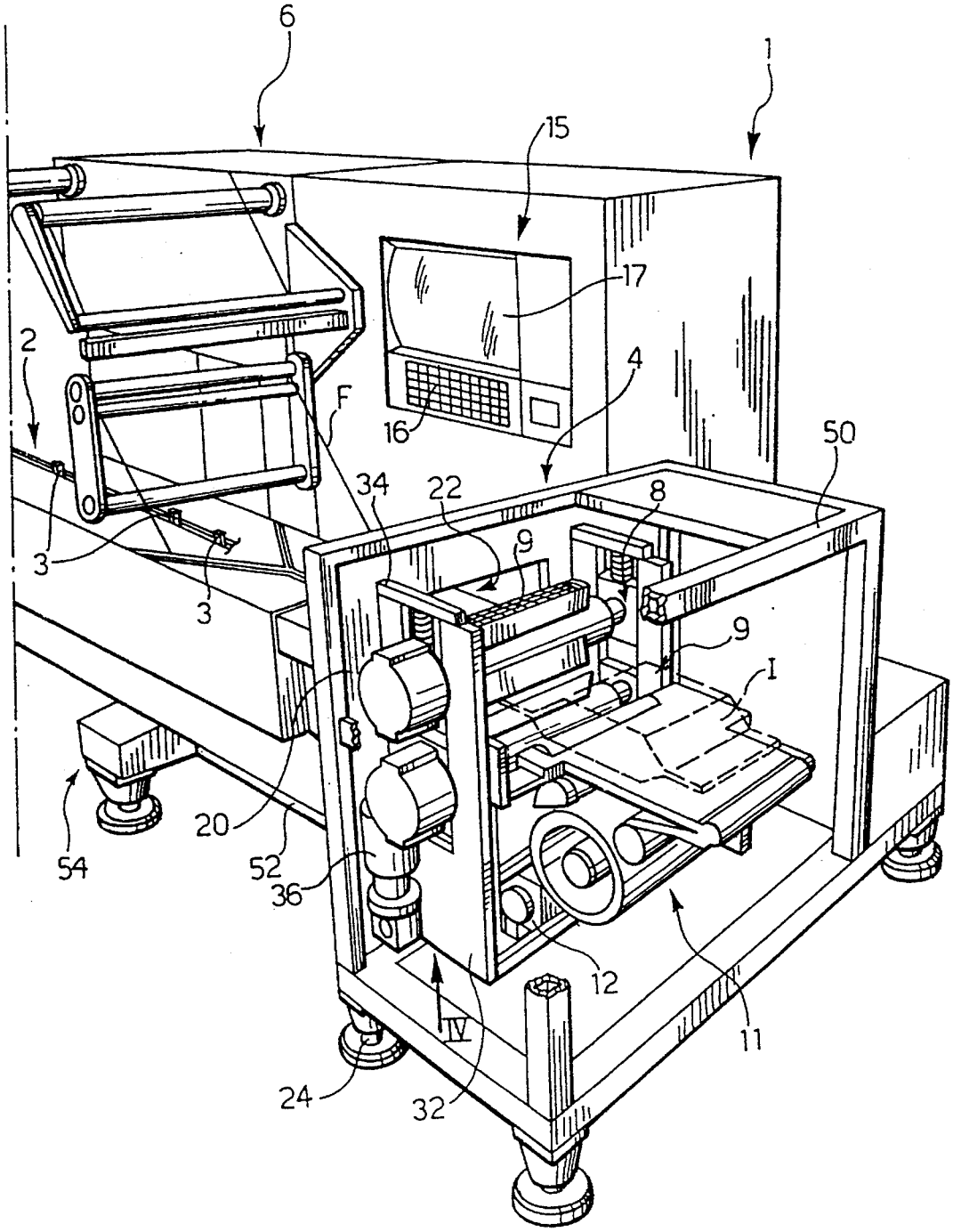
Figure 3:
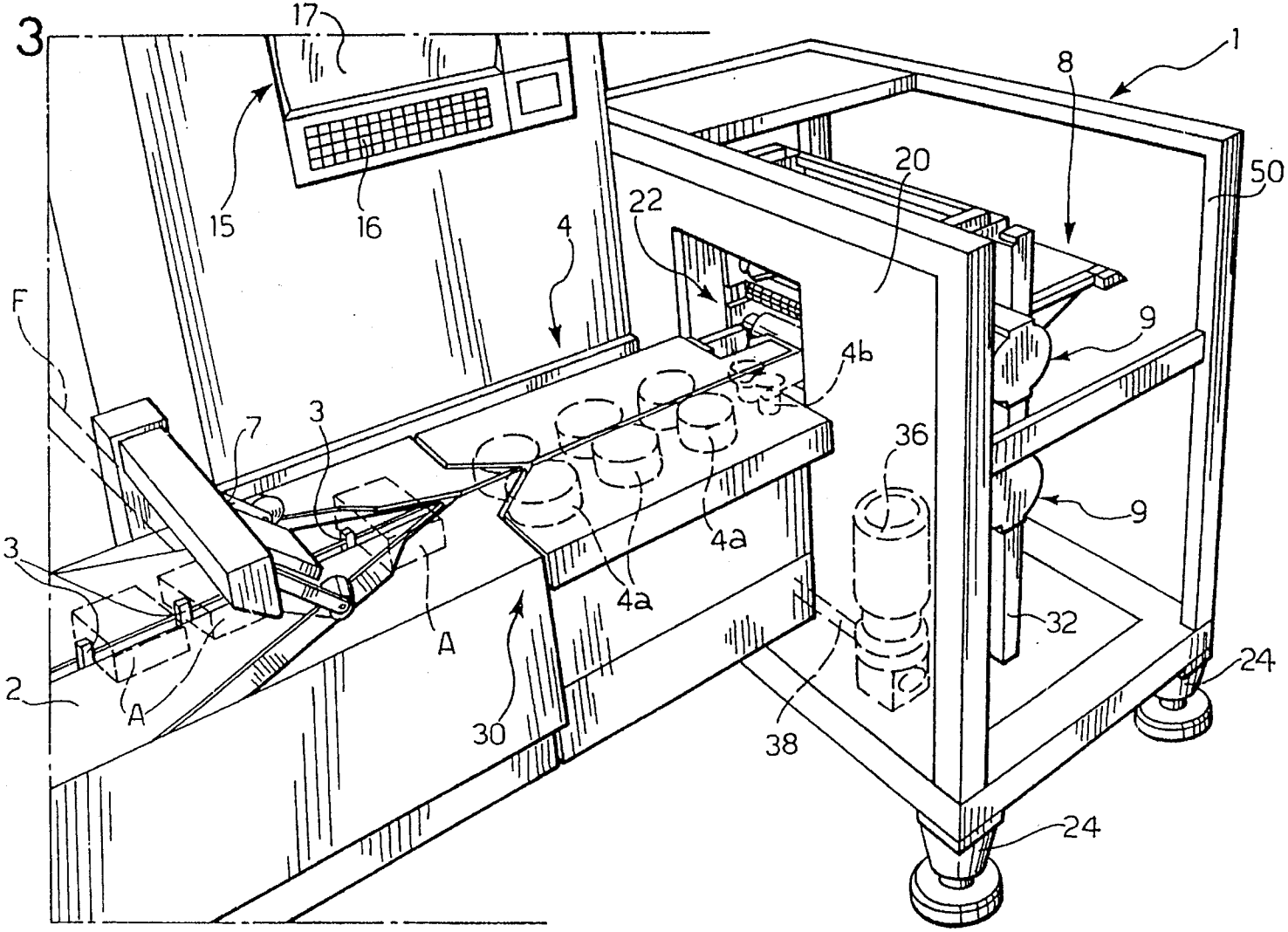
Figure 4:
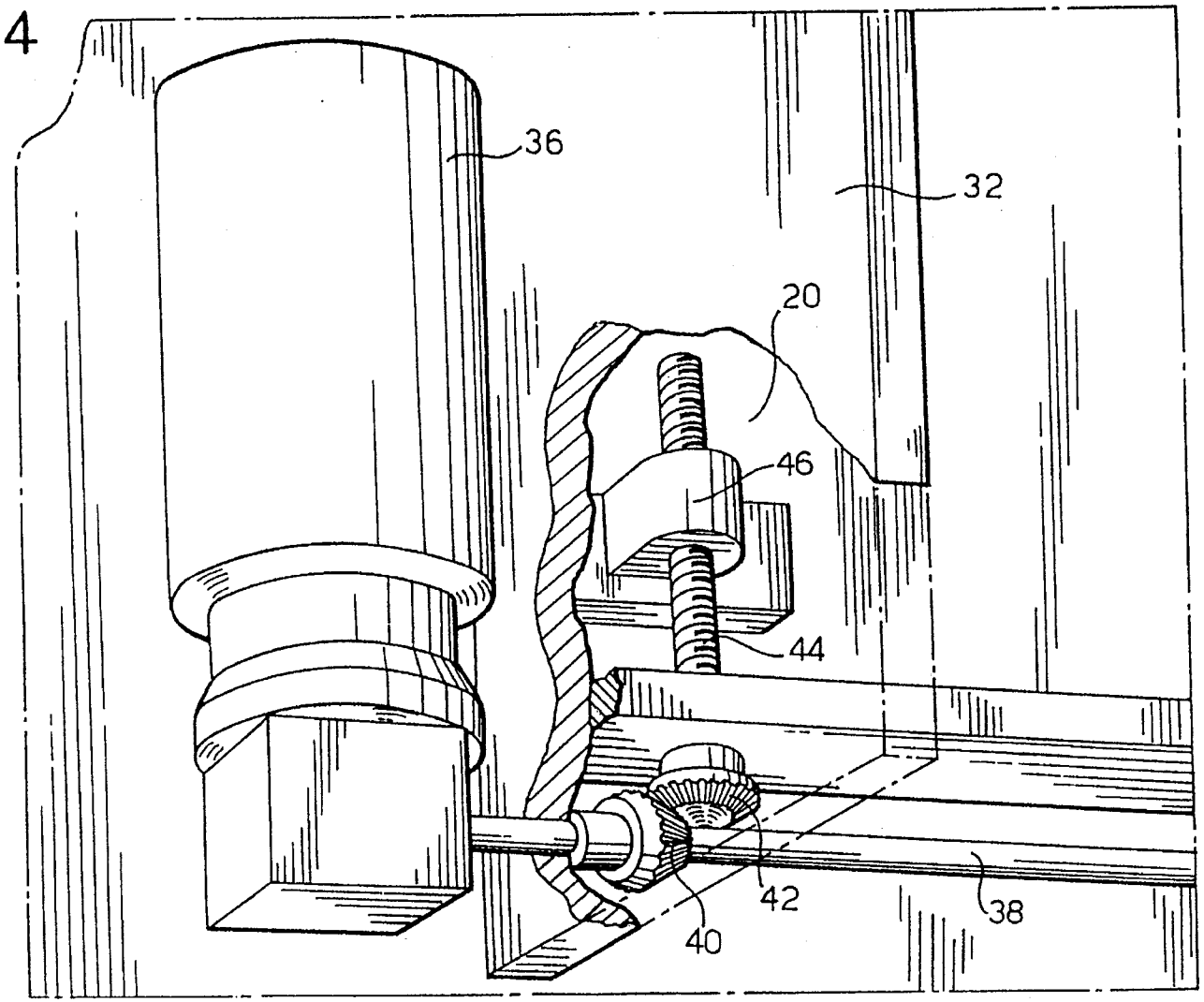

The invention will now be described, purely by way of non-limitative example, with reference to the appended drawings, in which:

FIG. 1 is a schematic side-elevational view of a packaging machine according to the invention, FIG. 2 is a perspective view of the downstream end of the machine of FIG. 1, FIG. 3 is a further perspective view of part of the machine of the invention, and FIG. 4 is a detail taken on the arrow IV of FIG. 2.

It should also be pointed out that the various views shown in FIGS. 1 to 3 may not appear to match each other entirely. This is due simply to the fact that, for clarity of illustration, those elements shown in detail in one drawing are not shown in the other drawings or are shown solely schematically: in each case the same reference numerals indicate exactly the same elements in the various views.

In the drawings a packaging (wrapping) machine of the continuously operating horizontal type usually called a "flow-pack" or "form-fill-seal" (FFS) packaging machine, is shown generally indicated 1.

Machines of this type are well known in the art as demonstrated for example, by the Patents listed in the introduction to the present specification.

According to well known criteria, the packaging machine in question includes, as operative units, intended to operate in sequence on a flow of articles A being packaged which advance in a direction of alignment defined by the unit itself (from left to right with reference to the drawings):

an input conveyor 2 usually constituted by a motor-driven endless conveyor belt or by an equivalent structure such as a motor-driven chain or belt system; all preferably with the provision of entrainment elements such as nibs or blades 3 intended to advance the individual articles A or group of articles in an ordered manner at regular spacings and in an exact phase relationship with respect to the other units of the machine, a longitudinal closure unit 4 usually constituted by a plurality of pairs (for example three or four pairs) of motor-driven wheels 4*a* with vertical axes (FIG. 4) and outer ribbed surfaces for clamping and welding together (for example by a heat-sealing action) the two flaps or edge portions of a wrapper sheet F (usually a transparent thermoplastics material or a metal, for example aluminium, foil coated on one of its faces with a heat-fusible material), the sheet F being fed downwardly from one or more rolls 5 in a supply unit 6 located generally above the machine to a so-called forming or shaping unit 7 which wraps the sheet F over on itself to form a continuous tubular wrapper into which the articles A are thrust by the nibs 3 of the conveyor 2, and a transverse closure unit 8 comprising, in the embodiment illustrated, two oppositely-rotating jaws 9 located respectively above and below the horizontal path of advance of the articles A within the tubular wrapper formed from the sheet F; the function of the transverse closure unit 8 is to squeeze the regions of the tubular wrapper left free between successive articles or groups of articles A and to weld together (for example by a heat-sealing process) these regions of the tubular wrapper brought into contact with each other as a result of the squeezing, and also to cut the heat-sealed zones so as to form separate wrappers I each of which contains a respective article or group of articles A.

The specific ways in which the various units 2, 4 and 8, disposed in cascade and aligned with each other in the direction of advance of the articles A, are made and operate are well known in the art and do not require specific explanation here, especially since they are not relevant for an understanding of the invention.

By way of reference, and still with reference to patents assigned to the applicant of the present application, and in particular to those already listed in the introduction to the present specification, with regard to the general organisation of the machine and its operative units it is possible to mention the U.S. Pat. Nos. 4,862,673, 4,914,889 and 4,955,184. With regard to the specific way in which the input conveyor 2 is made, reference may usefully be made to the U.S. Pat. Nos. 4,962,844 or 5,168,163, while, for the operation of the transverse closure unit one may usefully refer to the specification of U.S. Pat. No. 4,862,673 and, with regard specifically to the forming unit 7, to U.S. Pat. No. 4,761,937.

In particular it should be noted that the various units described above may be .arranged in different ways from that described, possibly with the inclusion of accessories associated with or incorporated in the units themselves. Thus, for example, the input conveyor 2 may, in practice, be constituted by. several conveyors in cascade with separate motor drives, for example whenever it is wished to carry out handling operations (orientation, accumulation, packing together, rotation, etc) on the articles A according to the specific operational requirements and conditions in which the articles A reach the machine 1 from the stations upstream thereof in the plant.

With regard to the presence of auxiliary elements or units in the region of the horizontal closure unit 4, (downstream of the wheels 4*a*) one may mention the presence of at least one other pair of vertical-axis wheels 4*b* with frusto-conical peripheral surfaces in complementary arrangements whose function is to fold the longitudinal seal of the tubular wrapper formed in the station 4 towards the plane on which the articles A slide, either towards the left or towards the right depending on the specific operational requirement.

It is also known to split the actions of squeezing, sealing and transverse cutting between two pairs of rotary jaws disposed in cascade: in this respect see U.S. Pat. No. 4,862,673. It is also known to associate the transverse closure unit 8 with an output conveyor 11 whose function is to transfer the separate wrappers I formed at the transverse closure and cutting station to further conveyors for the finished wrappers located downstream of the machine 1.

Finally it is known in the field of so-called "electronic" packaging machines to provide each operative unit with a respective motor drive: in the appended drawings only one of these motor drives is shown explicitly, that is, the electric motor 12 which drives the transverse closure unit 8. All the motor drives of the various operative units are subservient to an electronic control unit 15 (typically a so-called programmable logic controller or PLC) whose function is to coordinate the operation of all the motors and/or the actuators present in the machine 1 so as to ensure the necessary synchronisation of the phases and speeds of operation of the various operative units.

More particularly, it is known that it is possible to arrange the control unit 15 (which usually has an associated programming keyboard 16 as well as a video unit 17 as is typical of electronic work stations for personal computers) to modify the conditions of synchronisation of the movement of the various operative units selectively so as to enable them to be adapted to changed conditions of operation (for example different dimensions or characteristics of the articles A and of the wrapper I which it is wished to obtain) thus achieving the so-called "format change" operation.

An important characteristic of the machine of the invention lies in the fact that, instead of having a generally longitudinal supporting structure (which thus extends in the general direction of advance of the articles A) as is the case in prior art machines (mechanical and electronic) it includes at least one structural element having a load-bearing function which is oriented generally transverse the said direction of advance of the products.

In the specific case, this structural element is constituted by a generally flat frame 20 which extends vertically in a position intermediate the longitudinal closure unit 4 and the transverse closure unit 8. The units 4 and 8 together with their motor drives are thus mounted on the frame 20 so as to be supported thereby (in a generally bracket-like configuration) on respective opposite sides of the frame 20 itself.

In the embodiment illustrated, the said load-bearing element or transverse frame 20 is constituted by a strong plate having a window 22 intended to be traversed horizontally by the articles A which pass from the longitudinal closure unit 4 to the transverse closure unit 8 within the tubular wrapper.

Naturally the invention can easily be formed by equivalent structures, for example by load-bearing frames which are generally flat and extend generally transverse the direction of advance of the articles A and not necessarily traversed by the flow of products as is the case with the plate illustrated here in which the products pass through the window 22. In particular, the frame 20 or equivalent could be a continuous structure, such as that illustrated in the example, or a discontinuous and/or open structure (for example a grid-like structure): the whole depending on specific applicational requirements.

The frame 20, which rests on the ground through feet 24, is intended to support at least two of the operative units of the machine 1. In the embodiment illustrated, these are the longitudinal closure unit 4 and the transverse closure unit 8 which are mounted in a generally bracket-like arrangement with their respective associated motor drives on one side and the other of the frame 20.

This arrangement has shown to be particularly effective with regard to the general balance of the machine 1. This applies both to the longitudinal direction and the transverse direction (the said attributes being understood to refer to the direction of advance of the articles A).

Longitudinal balance or equilibrium is achieved in that each of the units 4, 8 in practice acts as a counterweight for the other in the imaginary balance structure of which the frame 20 effectively defines the fulcrum. Transverse balance or equilibrium is achieved in that both of the units 4 and 8 are mounted on the frame 20 almost symmetrically relative to an imaginery vertical longitudinal median plane through the machine (in which they differ from the arrangement in conventional machines). This avoids the configuration in which the units 4 and 8 are cantilevered from a frame which is to one side of the line of advance of the articles A, as occurs in the .prior art machines.

The structure described above thus enables a high degree of stability to be achieved (even with regard to resistance to vibration) with the added possibility of supporting other parts of the machine on the main load-bearing core identified by the frame 20.

This may be achieved by mounting other operative units in a bracket-like arrangement on the frame 20: this is the case, for example, with the further output conveyor 11 disposed downstream of the transverse closure unit 8 (see particularly FIG. 2).

In addition and/or alternatively, it is possible to consider supporting other operative units to make use of the load-bearing capacity of the frame 20 by supporting these other operative units from the units connected directly to the frame 20.

In the embodiment illustrated, this latter solution is adopted for the input conveyor 2 whose downstream end, indicated 30, is indeed connected to the upstream end of the longitudinal closure unit 4 in a generally balanced arrangement.

Naturally, the terms "upstream" and "downstream" are used here with reference to the direction of advance of the articles A (from left to right with reference to the drawings).

The presence of the frame 20 also enables the height of the operative units, such as the transverse closure unit 8, to be adjusted easily.

For this purpose, in the embodiment illustrated, the transverse closure unit 8 is mounted on a cage structure 32 (constituted, for example, by metal tubes and plates welded together) which in turn is slidable vertically on two guides 34 attached to the face of the frame 20 facing the transverse closure unit 8.

A further motor 36 is mounted on the cage structure 32 and drives a horizontal shaft 38 to the ends of which are keyed respective bevel gears 40. The gears 40 (only one of which is visible in FIG. 4) cooperate, in a known bevel-pair configuration, with respective further bevel gears 42 which are in turn keyed to threaded shafts 44 arranged with their axes vertical and engaged in respective internally threaded members 46 fixed to the frame 20.

Consequently, by operation of the motor 36 (which can be controlled selectively and automatically by the control unit 15) it is possible to raise or lower the transverse closure unit 8 selectively and, in particular, to vary the height of the imaginary plane or horizontal line in which the operative parts or anvils of the rotary jaws 9 come into contact with each other to effect the squeezing, closure and transverses cutting of the tubular wrapper.

The height of this imaginary plane must be selected in dependence on the dimensions of the articles A (and hence of the wrappers I) so as to be at a predetermined height which usually corresponds to the mid-height of the articles A.

In a machine according to the invention, the automatic adaptation known as format change may easily be extended to the adjustment of the height of the transverse closure station 8, avoiding any manual intervention in this respect.

The general characteristics of balance and equilibration described above with reference to the closure units 4 and 8 solve the problem of keeping the frame 20, which in practice constitutes the main load-bearing element of the machine, firmly in the desired vertical position.

For this purpose, as well as the additional framework (generally indicated 50 in FIG. 1) whose function, above all, is to enable the mounting of protective elements prescribed by safety regulations, it is possible to attach a foot or leg 52 (FIGS. 1 and 2) to the frame 20 as an element for supporting it on the floor, in addition to the feet 24, this leg extending horizontally over the floor from one of the lower vertices of the frame 20 and on one side of the machine in correspondence with the longitudinal closure unit 4 and part of the input conveyor 2: the whole arrangement is such as to add to the support structure for supporting the machine 1 on the floor which is constituted mainly by the frame 20 and by the leg 52 which is generally L shaped (in plan as seen from above).

Naturally, especially for machines intended to operate in particularly critical situations with regard to stress and overall equilibration, it is possible to consider associating other support elements with the frame 20 to act as buttresses in addition to the leg 52. For example, it is possible to consider attaching another generally flat, vertical frame (not illustrated) to the frame 20 on the opposite side from the leg 52 (and hence on the side facing the transverse closure unit 8), this further frame forming a generally dihedral structure with the frame 20 with an angle of opening equal for example to a right angle.

In each case, the presence of the support leg 52 is advantageous with regard to the possibility of arranging the electrical and electronic equipment (particularly the control unit 15 and electronic and electrical members associated therewith) above the leg 52 so as to be extremely closely integrated with the machine and hence enabling the overall bulk to be reduced.

In addition, the structure described has the advantage of isolating the electronic and electrical members completely from the purely mechanical members of the operative units and their motor drives.

In addition to this, the leg 52 may also be attached (for example bolted) to a further supporting foot 54 which extends beneath the input conveyor 2, transverse the direction of advance of the articles A and supports the rolls of the supply unit 6, from which the sheet material F is unrolled, above the conveyor 2 itself.

The presence of the further supporting foot 54 enables, so to speak, a synergic effect to be achieved with regard to the structural strength and equilibrium of the machine 1 as a whole.

On the one hand, in fact, the foot 54 cooperates with the leg 52 so as to keep the frame 20 in its vertical position even more firmly. On the other hand, as a result of the connection of the foot 54 to the leg 52, the supply unit 6 for supplying the sheet material F benefits from a very firm support and support structure resting directly on the floor.

What is claimed is:

1. In an automatic packaging machine including at least two operative units which are configured and arranged to act in succession on articles to be packaged and advance in a direction in which said at least two units are aligned, the improvement comprising generally flat, load-bearing frame which extends transverse to said direction of alignment of said at least two units, said at least two operative units being mounted so as to be supported by said frame on respective opposite sides of said frame itself such that said frame constitutes a fulcrum for said at least two units.

2. A machine according to claim 1, wherein said frame defines at least one aperture arranged to be traversed in use by said articles being packaged.

3. A machine according to claim 1, wherein said load-bearing frame is in the form of a plate.

4. A machine according to claim 1, wherein said machine defines a vertical median plane and each of said at least two operative units is mounted on said frame in a generally symmetrical position relative to said vertical median plane.

5. A machine according to claim 1, wherein said frame has an associated, generally horizontal leg for supporting it on the floor.

6. A machine according to claim 5, wherein said leg extends generally perpendicular to said frame (in plan as observed from above).

7. A machine according to claim 1, wherein said at least two operative units have respective associated motor drives and wherein said motor drives are also supported by said frame.

8. A machine according to claim 7, wherein said frame has an associated, generally horizontal leg for supporting an electronic control unit for controlling said motor drives and wherein said control unit is mounted in a position generally overlying said leg.

9. A machine according to claim 1, wherein means for mounting at least one of said at least two operative units on said frame is provided so as to be able to slide vertically in order to effect a selective adjustment.

10. A machine according to claim 9, including further drive means interposed between said frame and said at least one operative unit, the operation of which drives the sliding movement of said at least one operative unit relative to said frame.

11. A machine according to claim 1, wherein said machine is a continuous-flow horizontal packaging machine in which said articles are inserted in a tubular wrapping having a longitudinal closure which is subsequently closed in a transverse direction and wherein said at least two operative units are constituted respectively by a unit for forming said longitudinal closure and a unit for forming said transverse closure of said tubular wrapping.

12. A machine according to claim 11, wherein means for mounting said transverse closure unit on said frame is provided so as to be able to slide vertically whereby the height of the region in which said transverse closure unit operates may be adjusted selectively relative to the path of advance of said articles being packaged.

13. A machine according to claim 1, wherein at least one further operative unit is mounted on said load-bearing frame in a generally bracket-like arrangement.

14. A machine according to claim 11, wherein a motor-driven conveyor is located downstream of said transverse closure unit and is mounted on said load-bearing frame in a generally bracket-like arrangement.

15. A machine according to claim 1 wherein at least one of the said two operative units is associated in a supporting relationship and in a generally balanced configuration with at least one respective further operative unit.

16. A machine according to claim 11, wherein at least one of said two operative units is associated in a supporting relationship and in a generally balanced configuration with a conveyor for feeding said articles to said unit for forming said longitudinal closure.

17. A machine according to claim 11, wherein a supply unit is provided for supplying said unit for forming said longitudinal closure with sheet material for forming said tubular wrapper, and a support structure is operatively connected to said frame for supporting said supply unit.

18. A machine according to claim 17, wherein said frame has an associated, generally horizontal leg for support thereof on a floor, and said support structure is connected to said leg.

19. A machine according to claim 18, wherein said support structure includes a foot element connected to said leg.

* * * * *